US011454384B2

(12) United States Patent
Choi

(10) Patent No.: US 11,454,384 B2
(45) Date of Patent: Sep. 27, 2022

(54) LED LIGHTING LAMP WITH ENHANCED HEAT DISSIPATION FUNCTION

(71) Applicant: INNOCOMPANY CO., LTD, Namyangju-si (KR)

(72) Inventor: Ho Jeong Choi, Namyangju-si (KR)

(73) Assignee: INNOCOMPANY CO., LTD, Namyangju-si (KR)

( * ) Notice: Subject to any disclaimer, the term of this patent is extended or adjusted under 35 U.S.C. 154(b) by 41 days.

(21) Appl. No.: 16/618,333

(22) PCT Filed: May 29, 2018

(86) PCT No.: PCT/KR2018/006068

§ 371 (c)(1),
(2) Date: Nov. 29, 2019

(87) PCT Pub. No.: WO2018/225973

PCT Pub. Date: Dec. 13, 2018

(65) Prior Publication Data

US 2021/0156556 A1 May 27, 2021

(30) Foreign Application Priority Data

Jun. 7, 2017 (KR) ..... 10-2017-0070872

(51) Int. Cl.

| | |
|---|---|
| ***F21V 29/77*** | (2015.01) |
| ***F21V 5/00*** | (2018.01) |
| ***F21K 9/233*** | (2016.01) |
| ***F21V 17/12*** | (2006.01) |
| *F21Y 105/18* | (2016.01) |
| *F21Y 115/10* | (2016.01) |

(52) U.S. Cl.

CPC ..... *F21V 29/773* (2015.01); *F21K 9/233* (2016.08); *F21V 5/007* (2013.01); *F21V 17/12* (2013.01); *F21Y 2105/18* (2016.08); *F21Y 2115/10* (2016.08)

(58) Field of Classification Search

CPC ..... F21V 5/007; F21V 29/83; F21K 9/233
See application file for complete search history.

(56) References Cited

U.S. PATENT DOCUMENTS

| | | | | |
|---|---|---|---|---|
| 9,989,239 | B2 * | 6/2018 | Johnson | F21V 23/009 |
| 2011/0194282 | A1 * | 8/2011 | Paik | F21V 13/04 362/245 |
| 2011/0210657 | A1 | 9/2011 | Paik | |

(Continued)

FOREIGN PATENT DOCUMENTS

| | | |
|---|---|---|
| CN | 102506325 A | 6/2012 |
| CN | 202361134 U | 8/2012 |

(Continued)

OTHER PUBLICATIONS

Communication of European Patent Application No. 18814286.3 dated Feb. 5, 2021 which corresponds to this application.

(Continued)

*Primary Examiner* — Eric T Eide
(74) *Attorney, Agent, or Firm* — Goldilocks Zone IP Law

(57) ABSTRACT

The lighting lamp with an enhanced heat dissipation function of the present invention includes a main body, an LED module, a cylindrical fastening boss, a connection portion, a lens holder and a ring-shaped fixing cap.

4 Claims, 7 Drawing Sheets

(56) References Cited

U.S. PATENT DOCUMENTS

| | | | | |
|---|---|---|---|---|
| 2011/0317412 | A1 | 12/2011 | Paik et al. | |
| 2014/0247606 | A1 | 9/2014 | Chen et al. | |
| 2014/0334149 | A1* | 11/2014 | Nolan | F21K 9/60 362/235 |
| 2016/0363308 | A1* | 12/2016 | Shum | F21V 29/80 |

FOREIGN PATENT DOCUMENTS

| | | | |
|---|---|---|---|
| CN | 203131534 | U | 8/2013 |
| JP | 2009-267082 | A | 11/2009 |
| JP | 3164202 | U | 11/2010 |
| JP | 2016-76450 | A | 5/2016 |
| JP | 2016-76500 | A | 5/2016 |
| KR | 10-2012-0128470 | B1 | 11/2012 |
| KR | 10-1351986 | B1 | 1/2014 |
| KR | 10-2016-0118777 | A | 10/2016 |
| WO | 2012142068 | A2 | 10/2012 |

OTHER PUBLICATIONS

Communication of Japanese Patent Application No. 2019-567314, dated Dec. 22, 2020, which corresponds to this application.

* cited by examiner

LED LIGHTING LAMP WITH ENHANCED HEAT DISSIPATION FUNCTION

CROSS REFERENCE TO RELATED PATENT APPLICATION

This application claims the benefit under 35 U.S.C. Section 371 of PCT International Application No. PCT/KR2018/006068, filed on May 29, 2018, which claimed priority to Korean Patent Application No. KR 10-2017-0070872, filed on Jun. 7, 2017 the disclosures of which are hereby incorporated by the references.

TECHNICAL FIELD

The present invention relates to a method for sending or receiving, by a UE, data in a wireless communication system and, more particularly, to a method and apparatus for sending or receiving data using an unlicensed spectrum. The present invention relates to an LED lighting lamp with an enhanced heat dissipation function, and more particularly, an LED lighting lamp with an enhanced heat dissipation function, in which the LED lighting lamp is configured to be fitted into and connected to a socket, enables high temperature heat generated when LEDs are turned on to be rapidly dissipated to the outside through heat dissipation fins formed in a main body so as to have a further improved heat dissipation function, and allows simple assembly thereof so as to significantly improve productivity and repair workability.

BACKGROUND ART

In general, in an LED (Light Emitting Diode), electrical energy is directly converted into light energy. Accordingly, the LED is well known as a light source which has a low power consumption, has an excellent energy efficiency, emits excellent high brightness, and has a small and long lifespan as compared to light sources of the related art.

Accordingly, in recent years, various lighting lamps such as small LEDs which are compatible with the existing incandescent lamp fixed frame or 12V small halogen lamp fixed frame have been developed.

However, in the existing LED lighting lamp, even when the LED lighting lamp is operated with small watt (Watt), a high temperature of about 80° C. is generated. The high temperature is a direct factor to shorten a life of the LED lamp, and although the LED lamp has excellent advantages in terms of roughness compared to the existing incandescent lamp or fluorescent lamp, the LED lamp cannot be widely used.

Accordingly, an LED lighting lamp has been continuously developed to improve the heat dissipation function, and as an example, Korea Utility Model Registered No. 20-0455749 (LED lighting lamp having a heat dissipation function, and hereinafter, referred to as a "prior art").

In the prior art, an LED lighting lamp is disclosed. The LED lighting lamp includes a conical outer case which is connected to a power source and houses a light source having an LED lamp and a PCB, a conical reflector which is detachably installed to be in contact with an inside of the outer case and reflects light of the LED lamp such that the light is emitted to the outside, and a fixing frame which is formed in a ring shape to have the same diameter as that of the reflector, is installed to be in contact with the outer case and the reflector, and detachably fixes a lighting lens located in front of the reflector in the outer case to the outer case, in which the outer case is formed of any one of ceramics, aluminum (Al), or cemented carbide having excellent thermal conductivity, and forms an umbrella-shaped rib to provide a heat dissipating hole for dissipating heat between the ribs.

However, in the prior art, there is a large number of parts, and thus, an assembly work is very inconvenient. In addition, productivity is lowered, and repair workability is also significantly poor.

In addition, in the prior art, the light source is installed deeply inside the outer case. Accordingly, high temperature heat generated during use cannot be rapidly dissipated to the outside and remains inside the outer case. Therefore, the LED lamp constituting the light source deteriorates, and there is a serious problem that a life of the LED light lamp is shortened.

DISCLOSURE

Technical Problem

The present invention is made to solve the above-described problems of the related art, and an object thereof is to provide an LED lighting lamp with an enhanced heat dissipation function capable of being configured to be fitted and connected to a socket and enabling high temperature heat generated when an LED is turned on to be rapidly dissipated to an outside through a heat dissipating fin formed in a main body to further improve the heat dissipation function.

Another object of the present invention is to provide an LED lighting lamp with an enhanced heat dissipation function capable of simply performing assembly between parts to largely improve productivity and repair workability.

Technical Solution

In order to achieve the above objects, according to the present invention, there is provided a lighting lamp with an enhanced heat dissipation function, the lighting lamp comprising: a main body which has a fitting hole formed inwardly through a center portion of an upper surface of the main body, a plurality of heat dissipating fins formed along an outer peripheral surface of the fitting hole, and a mounting surface formed on a lower portion of the main body, the mounting surface having a single annular heat dissipating groove or a plurality of annular heat dissipating grooves; an LED module which is installed to be in close contact with the mounting surface formed on the lower portion of the main body and has a plurality of LEDs installed on a bottom surface of the LED module; a cylindrical fastening boss which is fastened by means of a screw to the LED module, which is in close contact with the mounting surface of the main body, while being fitted and coupled through the fitting hole from an upper side of the main body; a connection portion which is fitted into and electrically connected to a socket provided on a ceiling, a wall surface, or the like while being fitted and fixed to an outside of an upper portion of the fastening boss; a lens holder which is fitted and coupled to the bottom surface of the LED module so as to be spaced apart therefrom by a predetermined distance and has lenses mounted at positions corresponding to the respective LEDs constituting the LED module so as to diffuse illumination light emitted from the LEDs and irradiate the illumination light; and a ring-shaped fixing cap which is coupled to a lower end of the main body and is fastened to the lower end by means of a screw while enclosing the LED module and the lens holder.

In the present embodiment, a guide groove is formed in a longitudinal direction at a position at which an inner peripheral surface of the fitting hole on the main body is divided by a predetermined angle, a guide protrusion having a fastening hole formed inwardly from a lower end of the guide protrusion is formed in the longitudinal direction on an outer peripheral surface of the fastening boss corresponding to a position corresponding to the guide groove, and a screw insertion hole is formed in each of the mounting surface on the main body and a surface of the LED module corresponding to the position corresponding to the fastening hole on the guide protrusion.

In the present invention, a plurality of air passages which communicate with the annular heat dissipating groove and through which external air flows into the heat dissipating groove or heat flowing into the heat dissipating groove flows to the outside are radially formed on the mounting surface on the main body.

In the present invention, the annular heat dissipating groove which is formed on the mounting surface on the main body is formed to protrude upward to have a depth being in contact with the heat dissipation fin.

In the present invention, a plurality of protrusion jaws for forming gaps through which external air flows into the ring-shaped fixing cap along an inner peripheral surface of the ring-shaped fixing cap are formed at regular intervals.

In the present invention, in order to couple the LED module and the lens holder to each other in a state where the LED module and the lens holder are separated from each other, a plurality of coupling holes are formed on an edge surface of the LED module, coupling protrusions fitted into the coupling holes are formed on an upper edge surface of the lens holder corresponding to positions corresponding to the coupling holes, and a supporting jaw which supports the edge of the coupling hole is formed at an intermediate portion of each coupling protrusion.

In the present invention, a cover which covers an upper edge of the fitting hole formed in the main body is formed at an intermediate portion of the fastening boss, and a plurality of heat dissipating holes are formed in an upper portion of the cover.

Advantageous Effects

According to the present invention, the LED lighting lamp with an enhanced heat dissipation function is configured to be connected to the socket, high temperature heat generated when an LED is turned on flows into the heat dissipating groove formed on the mounting surface of the main body, and thereafter, is rapidly dissipated to the outside through the heat dissipation fin formed on the outer peripheral surface of the main body and the heat dissipating hole formed in the cover on the fastening boss. Therefore, it is possible to further improve heat dissipation function.

Moreover, assembly between parts such as fastening of the LED module with respect to the mounting surface of the main body and coupling between the lens holder and the fixing cap is very simple. Accordingly, it is possible to largely improve productivity and to largely enhance repair workability to improve convenience in the use.

MODE FOR INVENTION

Figure 1:
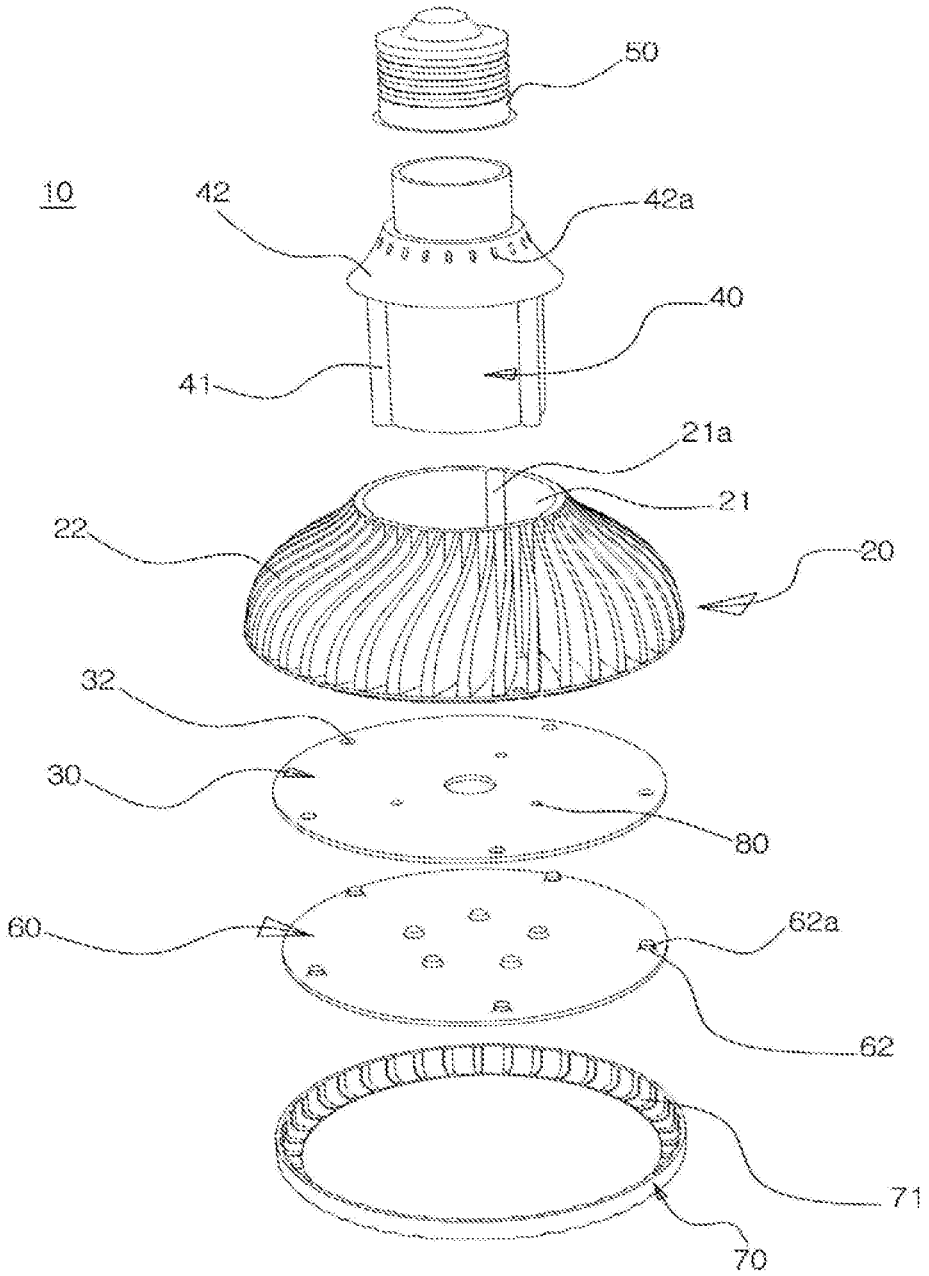
FIG. 1 is a planar exploded perspective view showing an LED lighting lamp with an enhanced heat dissipation function according to the present invention.
Figure 2:
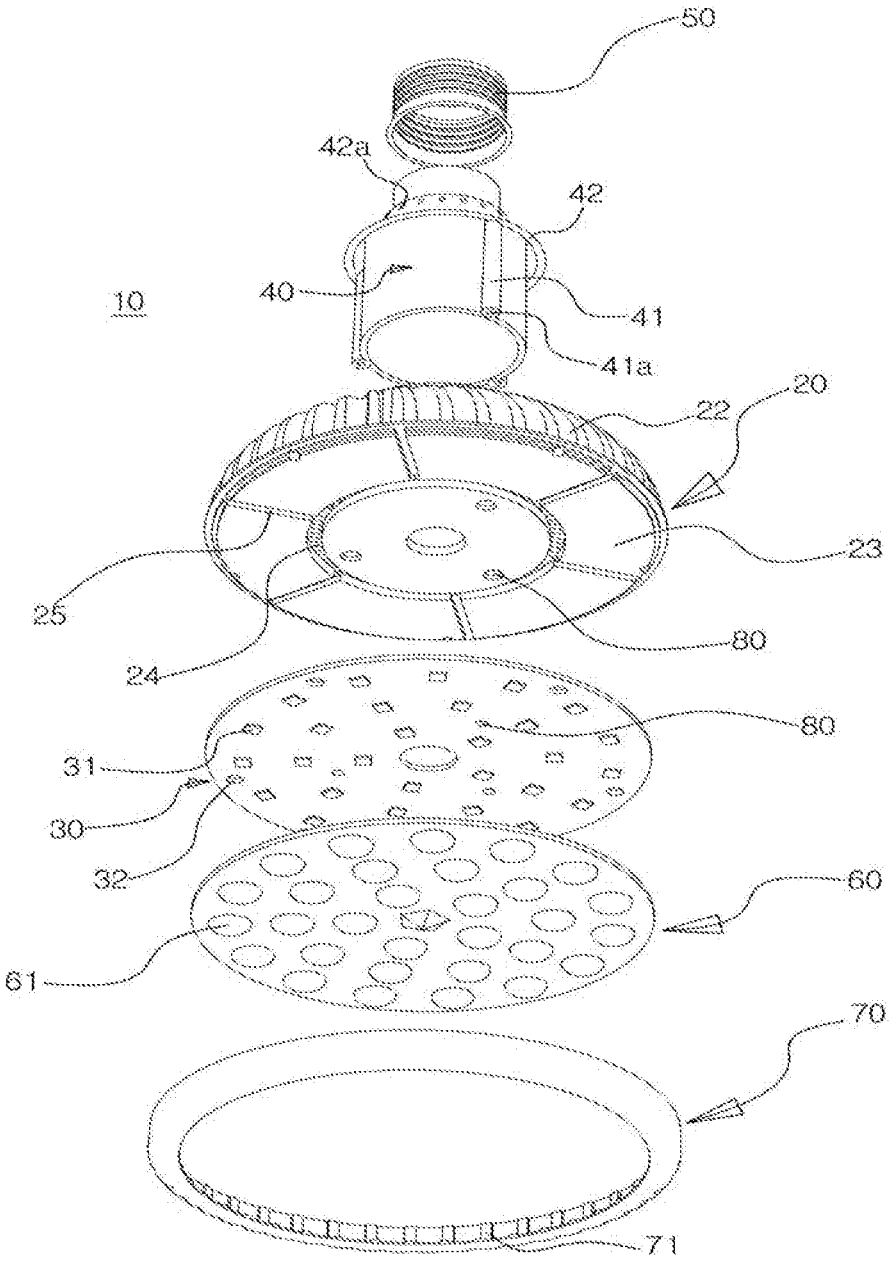
FIG. 2 is a bottom exploded perspective view showing the LED lighting lamp with an enhanced heat dissipation function according to the present invention.
Figure 3:
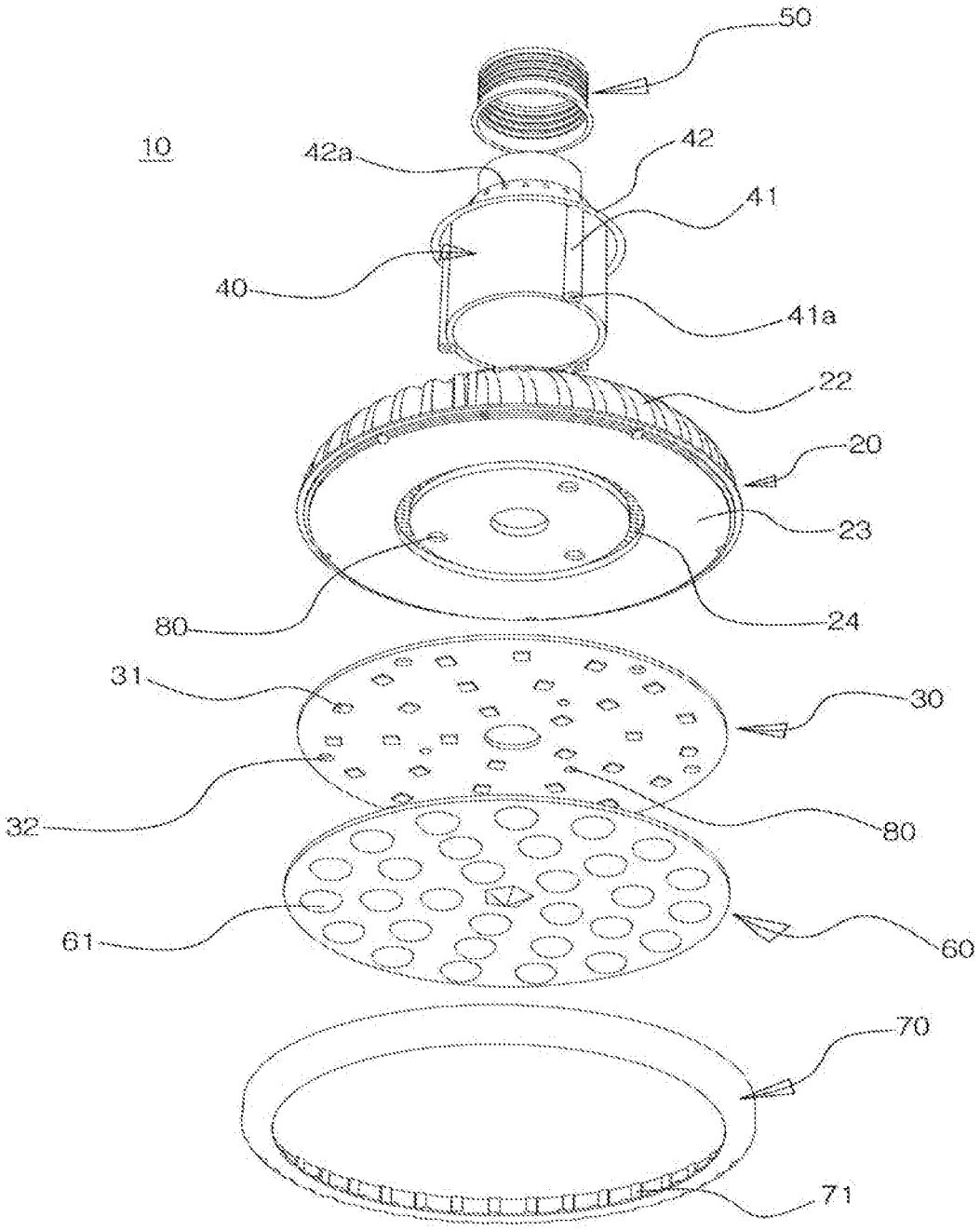
FIG. 3 is a bottom exploded perspective view showing an LED lighting lamp with an enhanced heat dissipation function according to another example of the present invention.
Figure 4:
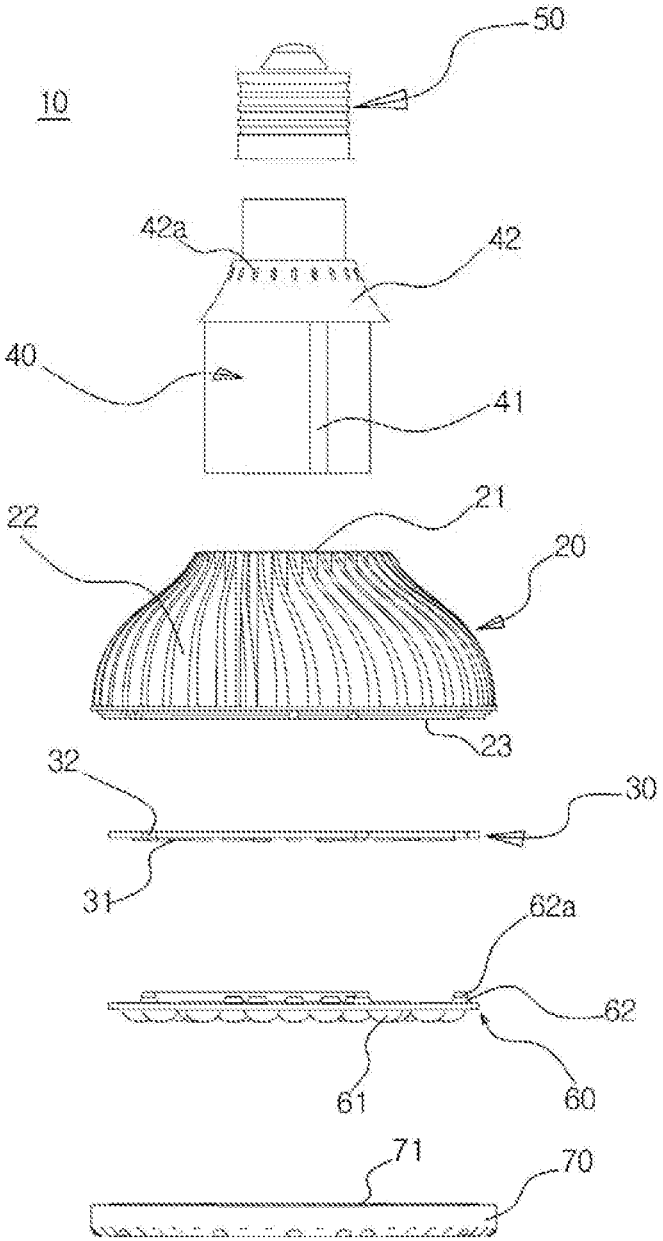
FIG. 4 is a front view showing the exploded LED lighting lamp with an enhanced heat dissipation function according to the present invention.
Figure 5:
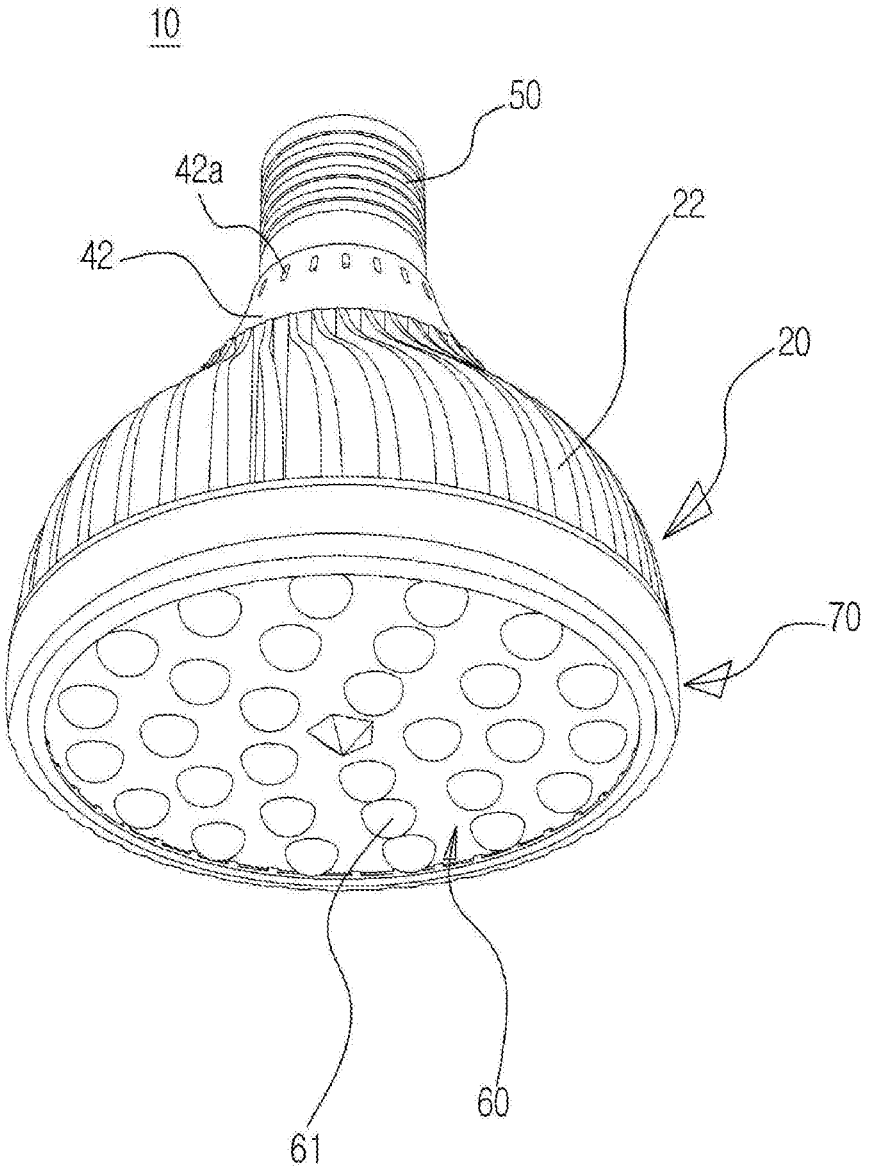
FIG. 5 is a perspective view showing the coupled LED lighting lamp with an enhanced heat dissipation function according to the present invention.
Figure 6:
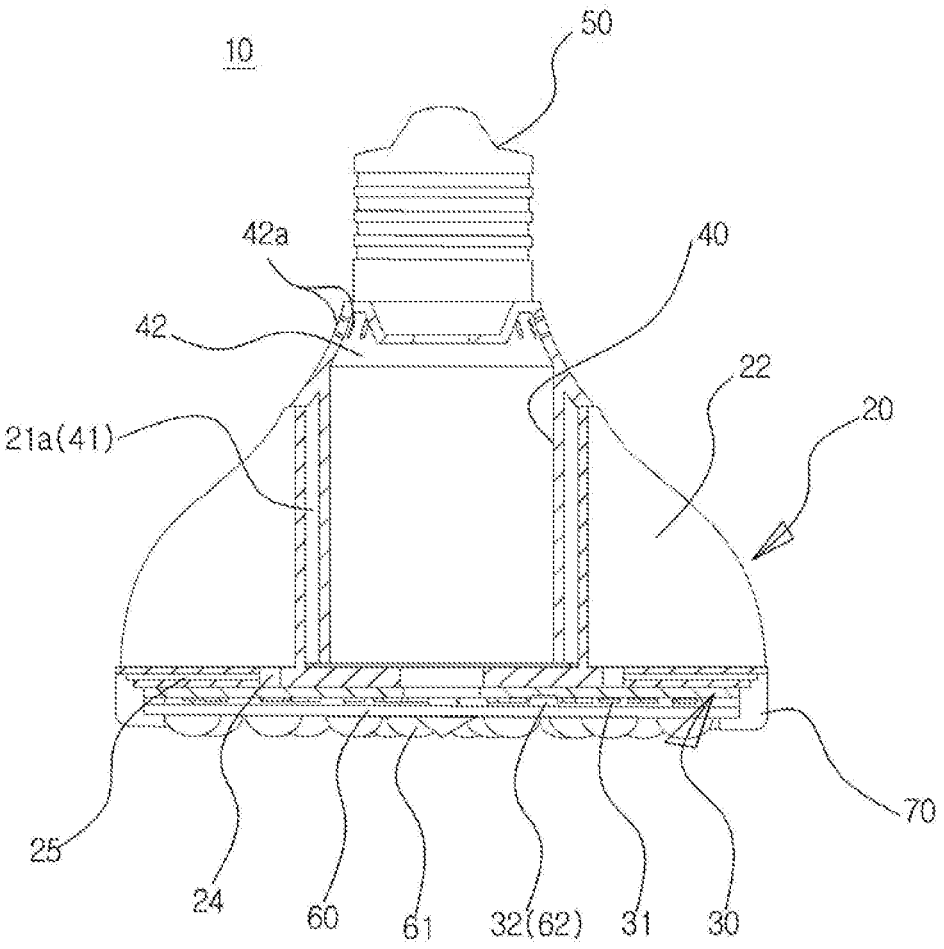
FIG. 6 is a cross-sectional view showing the coupled LED lighting lamp with an enhanced heat dissipation function according to the present invention.

Refer Hereinafter, preferred embodiment of the present invention will be described in detail with reference to the accompanying drawings.

With reference to FIGS. 1 to 7, an LED lighting lamp 10 with an enhanced heat dissipation function according to the present invention includes a main body 20 configured to be fitted and connected to a socket.

In the present invention, a fitting hole 21 is formed inwardly through a center portion of an upper surface of the main body 20, and a plurality of heat dissipation fins 22 are formed along an outer peripheral surface of the fitting hole 21.

Moreover, a mounting surface 23 is formed in a lower side of the main body 20, and a single annular heat dissipation groove 24 or a plurality of annular heat dissipating grooves 24 are formed on the mounting surface.

In the present invention, a LED module 30 is detachably installed while being in close contact with the mounting surface 23 formed in the lower side of the main body 20, and a plurality of LEDs 31 are installed on a bottom surface of the LED module 30.

In the present invention, a separated cylindrical fitting boss 40 is fitted and coupled to the main body 20 through the fitting hole 21 formed in the main body 20, the fastening boss 40 is configured to be fastened by means of a screw to the LED module 30 which is in close contact with the mounting surface 23 on the main body 20, and a connection portion 50 fitted into and electrically connected to a socket provided on a ceiling, a wall surface, or the like is fitted and fixed to an outside of an upper portion of the fastening boss 40.

Moreover, a separate lens holder 60 is fitted and coupled to the bottom surface of the LED module 30 so as to be spaced apart therefrom by a predetermined distance, and lenses 61 are mounted on a surface of the lens holder 60 corresponding to positions corresponding to the respective LEDs 31 constituting the LED module 30 so as to diffuse illumination light emitted from the LEDs 31 and irradiate the illumination light.

In addition, a separate ring-shaped fixing cap 70 is coupled by means of a screw to a lower end of the main body 20. The ring-shaped fixing cap 70 is coupled to the lower end of the main body 20 while enclosing edges of the LED module 30 and the lens holder 60, and thereafter, is fastened to the lower end by means of a screw such that an assembly of the LED module 30 and the lens holder 60 cannot be arbitrarily detached.

In the present invention configured as described above, a guide groove 21*a* is formed in a longitudinal direction at a position at which an inner peripheral surface of the fitting hole 21 on the main body 20 is divided by a predetermined angle, a guide protrusion 41 is formed in the longitudinal direction on an outer peripheral surface of the fastening boss 40 corresponding to a position corresponding to the guide groove 21*a*, and a fastening hole 41*a* is formed inwardly from an lower end of the guide protrusion 41.

In addition, a screw insertion hole 80 is formed in each of the mounting surface 23 on the main body 20 and a surface of the LED module 30 corresponding to the position corresponding to the fastening hole 41*a* on the guide protrusion 41.

In the present invention, a plurality of air passages 25 which communicate with the annular heat dissipating groove 24 and through which external air flows into the heat dissipating groove 24 or heat flowing into the heat dissipating groove 24 flows to the outside may be radially formed on the mounting surface 23 on the main body 20.

Figure 7:
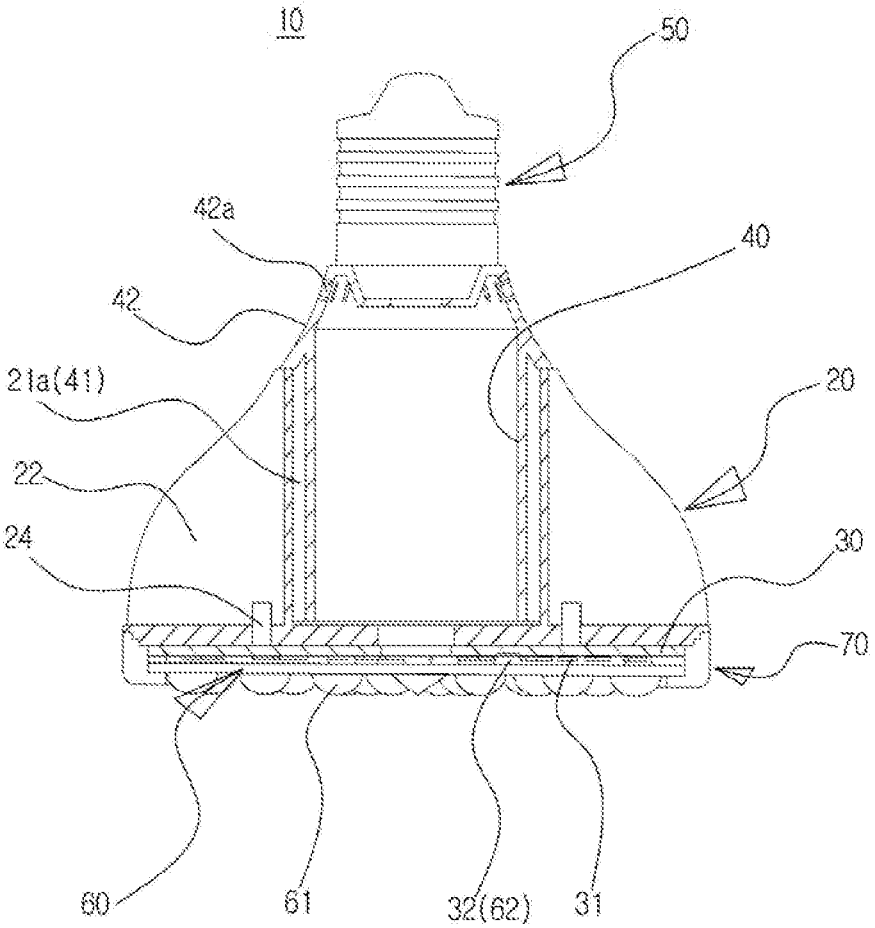
FIG. 7 is a cross-sectional view showing a coupled LED lighting lamp with an enhanced heat dissipation function according to another example of the present invention.

Moreover, in the present invention, as shown in FIG. 7, the annular heat dissipating groove 24 which is formed on the mounting surface 23 on the main body 20 is formed to protrude upward to have a depth being in contact with the heat dissipation fin 22.

In addition, a plurality of protrusion jaws for forming a gap through which external air flows into the ring-shaped fixing cap 70 may be formed at regular intervals on an inner peripheral surface of the ring-shaped fixing cap 70.

Moreover, in the present invention, in order to couple the LED module 30 and the lens holder 60 to each other in a state where the LED module 30 and the lens holder 60 are separated from each other, a plurality of coupling holes 32 are formed on an edge surface of the LED module 30, coupling protrusions 62 fitted into the coupling holes 32 are formed on an upper edge surface of the lens holder 60 corresponding to positions corresponding to the coupling holes 32, and a supporting jaw 62*a* which supports the edge of the coupling hole 32 is formed at an intermediate portion of the coupling protrusion 62.

Meanwhile, in the present invention, a cover 42 which covers an upper edge of the fitting hole 21 formed in the main body 20 is formed at an intermediate portion of the fastening boss 40, and a plurality of heat dissipating holes 42*a* are formed in an upper portion of the cover 42.

Effects of the present invention configured as above are as follows.

When the LED lighting lamp 10 with an enhanced heat dissipation function according to the present invention is assembled, first, the fastening boss 40 is fitted and coupled to the fitting hole 21 formed at the center portion of the main body 20 from above the fitting hole 21, and an upper surface of the LED holder 30 comes into close contact with the mounting surface 23 formed in a lower portion of the main body 20 such that the screw insertion hole 80 on the LED holder 30 coincides with the mounting surface 23. Thereafter, a screw is inserted through the screw insertion hole 80 from below the LED holder 30, and if the screw is coupled to the fastening hole 41*a* formed on a lower surface of the guide rib 41 on the fastening boss 40, the fastening of the LED holder 30 with respect to the main body 20 is completed.

In this state, the connection portion 50 for connecting the socket is fitted to an outer peripheral surface of an upper end of the fastening boss 40 such that the connection portion 50 is fixed, and the connection portion 50 and the LED module 30 are electrically connected to each other.

Thereafter, if the coupling protrusion 62 protruding from the edge of the upper surface of the lens holder 60 is fitted to the coupling hole 32 formed on the edge surface of the LED holder 30, the LED holder 30 and the lens holder 60 are coupled to each other in a state where the LED holder 30 and the lens holder 60 are separated from each other by a predetermined gap while the coupling hole 32 on the LED holder 30 is supported by the supporting jaw 62*a* on the coupling protrusion 62.

In this state, if the fixing cap 70 is coupled to an outer peripheral surface of the lower end of the main body 20 and is fastened by a screw in a state where outer peripheral surfaces of the LED holder 30 and the lens holder 60 are enclosed by the ring-shaped fixing cap 70, the assembly of the LED lighting lamp with an enhanced heat dissipation function according to the present invention is completed.

In this state, if the connection portion 50 which is fitted and coupled to the upper end of the fastening boss 40 is connected to the socket installed in the ceiling or wall surface and power is supplied, illumination light is emitted while the LEDs 31 mounted on the LED module 30 are turned on, and the illumination light emitted from the LEDs is diffused and irradiated through a lens on the lens holder 60.

Meanwhile, high temperature heat is generated when the LEDs are turned on as described above. Most of the heat generated from the LEDs 31 is transmitted to the heat dissipation fins 22 on the main body 20 through the annular heat dissipating groove 24 formed on the mounting surface 23 on the main body 20 and, thereafter, is rapidly dissipated to the outside. A portion of the heat is introduced to the inside of the fastening boss 40, and thereafter, is rapidly dissipated to the outside through the heat dissipating holes 42*a* on the cover 42.

In this way, in a case where the air passage 25 is formed on the mounting surface 23 when the heat is dissipated, the heat is dissipated to the outside through the air passage 25 or cool air flows into the annular heat dissipating groove 24 through the air passage 25 from the outside, and thus, it is possible to largely improve heat dissipation efficiency.

Moreover, the external air flow into the ring-shaped fixing cap 70 through the gap formed between the protrusion jaws 71 of the inner surface of the ring-shaped fixing cap 70. Accordingly, heat dissipation can be realized by natural convection.

INDUSTRIAL APPLICABILITY

The present invention relates an LED lighting lamp with an enhanced heat dissipation function, and can be applied to indoor or outdoor bulb and a lighting industry.

What is claimed is:

1. A lighting lamp with an enhanced heat dissipation function, the lighting lamp comprising:

a main body which has a fitting hole formed inwardly through a center portion of an upper surface of the main body, a plurality of heat dissipating fins formed along an outer peripheral surface of the fitting hole, and a mounting surface formed on a lower portion of the main body, the mounting surface having a single annular heat dissipating groove or a plurality of annular heat dissipating grooves;

an LED module which is installed to be in close contact with the mounting surface formed on the lower portion of the main body and has a plurality of LEDs installed on a bottom surface of the LED module;

a cylindrical fastening boss which is fastened by a screw to the LED module, which is in close contact with the mounting surface of the main body, while being fitted and coupled through the fitting hole from an upper side of the main body;

a connection portion which is fitted into and electrically connected to a socket provided on a ceiling, a wall surface, or the like while being fitted and fixed to an outside of an upper portion of the fastening boss;

a lens holder which is fitted and coupled to the bottom surface of the LED module as coupling protrusion of the lens holder is coupled to coupling holes of the LED module, wherein the lens holder has lenses mounted at positions corresponding to the respective LEDs constituting the LED module to diffuse illumination light emitted from the LEDs and irradiate the illumination light;

a ring-shaped fixing cap which is coupled to a lower end of the main body and is fastened to the lower end by a screw while enclosing the LED module and the lens holder; and a plurality of air passages which communicate with the annular heat dissipating groove and through which external air flows into the heat dissipating groove or heat flowing into the heat dissipating groove flows to the outside are radially formed on the mounting surface on the main body;

gaps formed at regular intervals on a plurality of protrusion jaws for through which external air flows into the ring-shaped fixing cap along an inner peripheral surface of the ring-shaped fixing cap;

a supporting jaw which supports an edge of the coupling hole formed at an intermediate portion of the coupling protrusion;

a cover which covers an upper edge of the fitting hole formed in the main body formed at an intermediate portion of the fastening boss; and a plurality of heat dissipating holes formed in an upper portion of the cover.

2. The lighting lamp of claim 1, wherein a guide groove is formed in a longitudinal direction at a position at which an inner peripheral surface of the fitting hole on the main body is divided by a predetermined angle, a guide protrusion having a fastening hole form inwardly from a lower end of the guide protrusion is formed in the longitudinal direction on an outer peripheral surface of the fastening boss corresponding to a position corresponding to the guide groove, and a screw insertion hole is formed in each of the mounting surface on the main body and a surface of the LED module corresponding to the position corresponding to the fastening hole on the guide protrusion.

3. The lighting lamp of claim 1, wherein the annular heat dissipating groove which is formed on the mounting surface on the main body is formed to protrude upward to have a depth being in contact with the heat dissipation fin.

4. The lighting lamp of claim 1, wherein to couple the LED module and the lens holder to each other in a state where the LED module and the lens holder are separated from each other, a plurality of coupling holes are formed on an edge surface of the LED module, coupling protrusions fitted into the coupling holes are formed on an upper edge surface of the lens holder corresponding to positions corresponding to the coupling holes.

* * * * *